US007882783B2

(12) United States Patent
Kaiser et al.

(10) Patent No.: US 7,882,783 B2
(45) Date of Patent: Feb. 8, 2011

(54) METHOD AND SYSTEM FOR DIGITAL IMAGING OF PRINTING FORMS

(75) Inventors: Michael Kaiser, Heidelberg (DE); Ludo Kerz, Nieder-Olm (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 1682 days.

(21) Appl. No.: 10/730,471

(22) Filed: Dec. 8, 2003

(65) Prior Publication Data

US 2004/0114125 A1 Jun. 17, 2004

(30) Foreign Application Priority Data

Dec. 9, 2002 (DE) ..... 102 57 372

(51) Int. Cl.
*B41C 1/055* (2006.01)

(52) U.S. Cl. ..... 101/467; 101/450.1; 101/453

(58) Field of Classification Search ..... None
See application file for complete search history.

(56) References Cited

U.S. PATENT DOCUMENTS 6,378,432 B1 4/2002 Lewis ..... 101/467
6,432,211 B1 8/2002 Schmitt et al. ..... 134/6
2002/0015042 A1 * 2/2002 Robotham et al. ..... 345/581

FOREIGN PATENT DOCUMENTS

EP 0887204 12/1998

* cited by examiner

*Primary Examiner*—Joshua D. Zimmerman
(74) *Attorney, Agent, or Firm*—Davidson, Davidson & Kappel, LLC

(57) ABSTRACT

A method for digital imaging of a printing form (10) through application of energy is described, in which a burn-off area (66) is detachably fixed by supporting points (68, 84), supporting points (68, 84) being left in place on the printing form (10) through non-imaging of image spots (112) and in which the burn-off from the burn-off area (66) is detached from the printing form (10) in a cleaning step. A supporting point (68, 84) at a reference point is left in place precisely if the number of image spots (110) to be imaged in a surrounding area (18) of the reference point (12) exceeds a limit value and a boundary area (20) in the surrounding area (18) around the reference point (12) contains only image spots (110) to be imaged. The method may be used in a system for digital imaging of printing forms (10) having an energy source (86), a cleaning unit (70), a control unit (96), and an image processing unit (98) with a computing unit (100), in particular with a raster image processor (RIP) (102) in a printing unit of a printing press.

10 Claims, 6 Drawing Sheets

METHOD AND SYSTEM FOR DIGITAL IMAGING OF PRINTING FORMS

Priority German Patent Application No. 102 57 372.7, filed Dec. 9, 2002 and hereby incorporated by reference herein, is claimed.

BACKGROUND INFORMATION

The present invention relates to a method for digital imaging of a printing form through application of energy, in which a burn-off area is detachably fixed by supporting points in the burn-off area, supporting points being left in place on the printing form by non-imaging of image spots, and in which the burn-off from the burn-off area is detached from the printing form in a cleaning step. Furthermore, the present invention relates to a system for digital imaging of printing forms in such a method, having an energy source, a cleaning unit, a control unit, and an image processing unit with a computing unit.

Use is frequently made in the graphics industry of printing forms which in addition to other method steps are structured or imaged by ablation into ink-receptive (oleophilic) and ink-repellent (oleophobic) sections on a printing area. The imaging of a printing form may take place in an exposure device or directly in a printing unit. The image information is transferred to the printing form as the carrier or master, through the application of energy. In other words, a positive structuring of the printing form takes place. Depending on its characteristics, the material of the printing form is in some cases changed to such a degree that a layer of dust and/or a skin forms on the surface. In a dry offset printing process multi-layer ablation printing forms may be used, whose areas of the top layer are to some extent detached, etched, or loosened, using a laser beam.

For example, the upper layer may be a silicon layer which is disposed upon a metallic or polymer layer (e.g., polyester). The upper layer is ink-repellent, while the layer below it is ink-receptive. By way of a cleaning unit, the burn-off is completely loosened by mechanical means and removed. Such a method for cleaning an imaged printing form of burn-off or imaging residues is described in patent EP 0 887 204 A2, hereby incorporated by reference herein.

In the specific case of imaging of printing forms by ablation in a printing unit of a printing press, complications may arise in the method as described. Provided that only small burn-off areas are detached by the imaging, they can be removed from the printing area by the cleaning unit, through frictional relative movement and vacuum extraction. Removal may, however, be problematical if large areas are imaged, resulting in large burn-off areas being detached. The larger the area that is imaged in one piece, the greater the probability that parts of the burn-off area will become completely detached. If the residual adhesion of the detached burn-off area is too low, a layer of dust and/or a skin forms which may become completely detached in small pieces, free of any control. A controlled cleaning of the printing area and removal of the burn-off is made harder or even impossible thereby. There is a danger that residues of the burn-off will penetrate into the printing unit, and in particular into the inking unit, onto the rubber blanket cylinder, or onto the pressure cylinder, with the result that the quality of the printing which occurs after the imaging may be severely impaired.

In order to make the controlled and complete elimination of the burn-off in the cleaning step possible, burn-off areas can be fixed by supporting points. In a partially detached burn-off area, at least at one location or reference point a dot is created at which the bond between the upper layer and the layer below it is either not loosened by application of energy, or is only partially detached. In other words, a supporting point is created in the form of an un-imaged or omitted dot in the burn-off area.

In normal high-resolution imaging, supporting points are distributed in a uniform grid across the entire printing area. In systems for digital imaging of a printing form with high resolution, typically of the order of 10 micrometers for the individual printing dots, the supporting points are too small to be seen with the naked eye. The impression given by the printed image, or the print quality, is consequently not impaired.

The insertion of supporting points is achieved by modifying the imaging data in the following manner: before imaging, the data is present in digital form, represented as a two-dimensional bit field (bit map, raster). At every position, the bit field has a representation of the information as to whether imaging at a reference point on the printing form corresponding to that position should be undertaken or not. At every position, a bit may be either set or un-set. If at uniform intervals in the two linearly independent directions at certain positions in the bit field individual set bits (on bits, "1") are replaced by un-set bits (off bits, "0"), supporting points result at the corresponding reference points on the printing form, in the form of small un-imaged areas on a uniform grid. The residual adhesion of the imaged area surrounding the reference point can be increased so far thereby that uncontrolled complete detachment does not occur. It is immediately clear that the number of supporting points has to be kept as low as possible.

Simply transferring the described procedure to low-resolution imaging, however, leads to impairment of the print quality, since individual supporting points may become visible in the printed image.

BRIEF SUMMARY OF THE INVENTION

An object of the present invention is to specify a method and a system for digital imaging of a printing form in which burn-off areas are fixed by supporting points, with the position of the supporting points being such that the impression given by the printed image information is not impaired. In other words, an object of the present invention is to avoid negative influences on the print quality resulting from the use of supporting locations. In addition or alternatively, an object is to avoid extra time-consuming method steps in the creation of supporting points.

According to the present invention, in a method for digital imaging of a printing form by the application of energy a burn-off area is detachably fixed by supporting points in the burn-off area. Supporting points are left in place on the printing form through non-imaging of image spots, and the burn-off from the burn-off area is detached from the printing form in a cleaning step. At least one of the supporting points at a reference point is left in place precisely if the number of image spots to be imaged in a surrounding area of the reference point exceeds a limit value and a boundary area in the surrounding area around the reference point contains only image spots to be imaged.

The present invention is based in part on the idea that supporting points at reference points should be generated as a function of the image information to be printed. To this end the image spots in the area surrounding a reference point are examined (surrounding area analysis). The extent of a boundary area is determined by the maximum size that a full-tone area may be, without occurrence of uncontrolled detachment.

The examined surrounding area is larger than the boundary area. For example, the surrounding area consists of the printing dots in the boundary area and all printing dots directly adjacent to the boundary area. If only image spots which are to be imaged lie within the boundary area and in the surrounding area there are more image spots to be imaged than a certain limit value, for example the number of image spots to be imaged in the boundary area, in particular if one or more areas having additional image spots to be imaged are adjacent to the boundary area, then the surrounding area has a full-tone area which is at risk of uncontrolled detachment. In this case in particular, a supporting point will be generated in the method according to the present invention. If, however, the boundary area is not a full-tone area or there are fewer image spots to be imaged in the surrounding area than a particular limit value, in particular if no area with additional image spots to be imaged is adjacent to the boundary area, then in the surrounding area there is no danger of uncontrolled detachment. In such cases, no supporting point is generated in the method according to the present invention.

If supporting points are set in small, full-cover areas (letters, lines, or similar), they may be distracting. In addition, with small burn-off areas the danger of uncontrolled detachment is less than with large burn-off areas. If a supporting point is to be set, a surrounding area analysis of the adjacent image spots is carried out.

In the method according to the present invention for digital imaging of a printing form, it is possible to determine the number of image spots to be imaged in a surrounding area of a reference point in an analysis of the image data represented in digital form as a bit field. A surrounding area analysis may, therefore, be carried out in a surrounding area around a position in the bit field which corresponds to the reference point. In other words, supporting points may be generated on the basis of the bit field.

In a calibration taking place earlier than the method, it is possible to determine the geometric shape and extent of the surrounding area and/or the limit value and/or the geometric shape and extent of the boundary area and/or the distance from a first reference point to a second reference point. Calibration may be carried out by printing tests. In other words, values for the parameters mentioned are determined in printing tests. The geometric shape (circle, square, or similar) and extent (radius) of the surrounding area in which the surrounding area analysis is carried out, and of the boundary area at a size at which no uncontrolled detachment yet occurs, are to be determined in printing tests for the printing form actually used. It is advantageous for good print quality to provide for as few supporting points as possible. For this reason and others, the maximum possible distance between the supporting points is determined by printing tests.

The method according to the present invention may be performed iteratively. In other words, it may be determined at a plurality of reference points whether the limit value has been exceeded, with the reference points being distributed in a uniform grid over the printing area of the printing form. In other words, it may be particularly advantageous to set the supporting points at uniform intervals and in particular at intervals that are as large as possible. The interval may be greater than, equal to, or smaller than the extent of the boundary area. In such a procedure, supporting points may be set to match the needs relating to the actual image information to be printed, the subject. The total image information is observed at a plurality of uniformly distributed positions. The method is robust with respect to different subjects to be printed.

In an advantageous embodiment of the method according to the present invention, the distance from a first reference point to a second reference point is essentially identical to the extent of the boundary area. In other words, the reference points are so close together that the boundary areas touch one another. Tight coverage (depending on the geometric shape of the boundary area, this may be complete or incomplete) of the printing area with boundary areas is achieved. A surrounding area analysis is thereby carried out over the printing area to the most complete extent possible.

The inventive idea also includes a device: a system according to the present invention for digital imaging of printing forms in a method according to this description includes an energy source, a cleaning unit, a control unit, and an image processing unit with a computing unit. In the computing unit of the image processing unit of the system according to the present invention a program is executable, the program having at least one part or section in which at a number of positions in a bit field representing the image data in digital form, which correspond to the reference points, it is determined whether the limit value has been exceeded. In this description the image processing unit is understood to be a part of the system for digital imaging: the system includes a device for digital imaging and an image processing unit connected to it.

In a preferred embodiment, the image processing unit includes a raster image processor (RIP) and a data buffer (working memory) for the image data represented in digital form as a bit field. The program may have at least one part or section in which the bit field is modified in at least one area at the positions at which the limit value is exceeded. In order to achieve rapid processing to create the supporting point, a partial area of the image information is rastered and stored in the data buffer (working memory), and a supporting point is set depending on the results of the surrounding area analysis. The modified partial area may then be stored.

The overall inventive idea also includes the use of the method according to the present invention and/or of the system according to the present invention for imaging in a printing unit and/or in a printing press. A printing unit according to the present invention includes a system according to the present invention for imaging as described in this description. The printing unit may, in particular, be a direct or indirect flatbed printing unit, a wet offset printing unit, a dry offset printing unit, or similar. A printing press according to the present invention has at least one printing unit according to the present invention. The printing press may be a sheet-fed or web-fed press. Typical printed materials are paper, cardboard, paperboard, organic polymers (in the form of fabrics, sheets, or workpieces), or similar. A sheet-fed printing press may have a feeding unit, a delivery unit and if appropriate also at least one finishing system (varnishing unit, stamping unit, corrugating unit, or similar). A web-fed printing press may have a reel changer, a dryer, and a folder.

BRIEF DESCRIPTION OF THE DRAWINGS

Further advantages and advantageous embodiments and refinements of the invention are represented on the basis of the following figures and their description.

DETAILED DESCRIPTION

Figure 1:
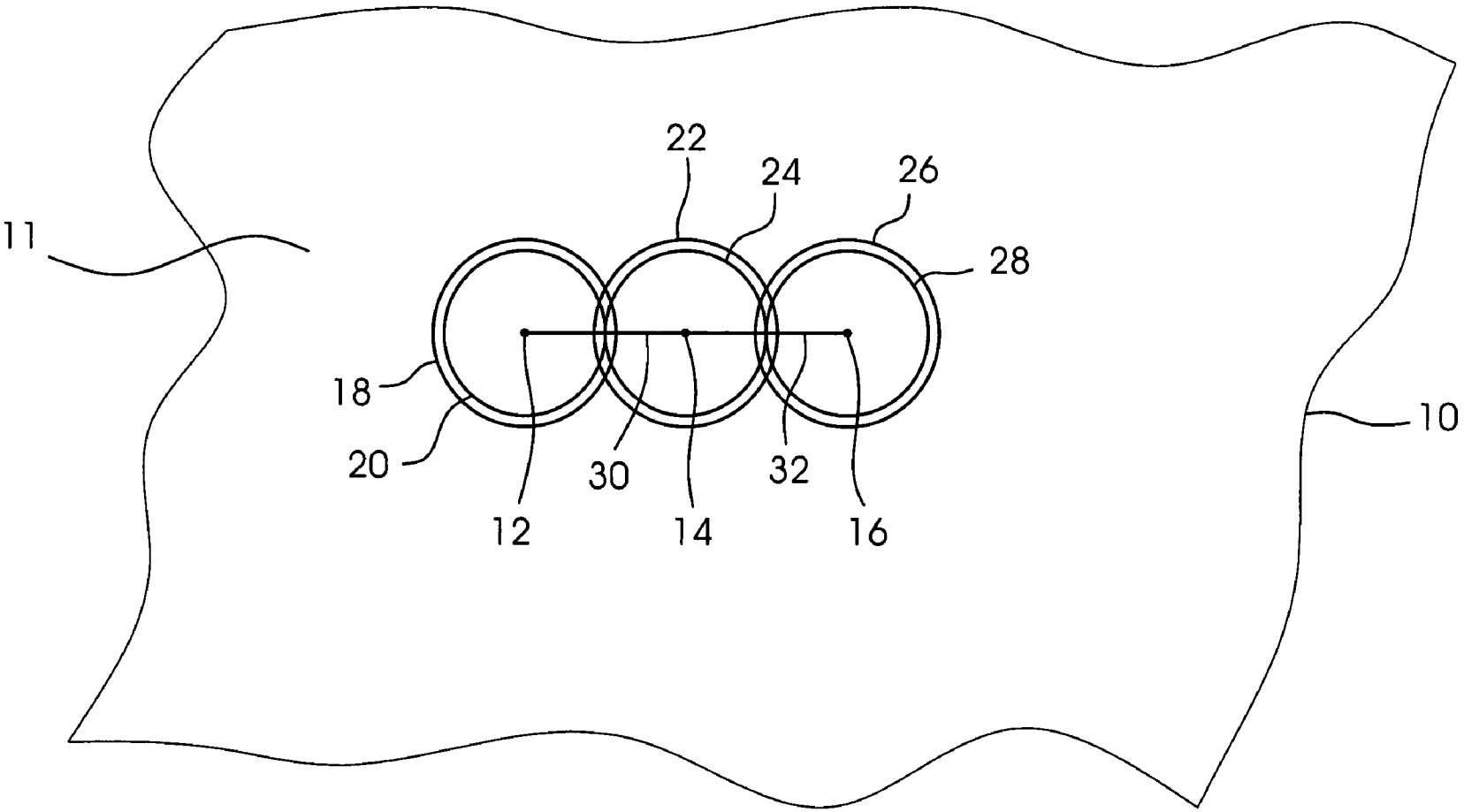
FIG. 1 shows an illustration to explain the position of boundary areas and areas surrounding reference points in a printing area of a printing form in one embodiment.

FIG. 1 is an illustration serving to explain the position of the boundary areas and areas surrounding reference points in the printing area of a printing form in one advantageous embodiment. In this advantageous embodiment, the surrounding areas and boundary areas (maximum area which does not become detached free of control) are circular areas around the reference points. The radii of the surrounding area and the boundary areas are determined for the specific material of the printing form's surface 11 through printing tests. On printing area 11 of printing form 10 a plurality of reference points which tightly cover printing area 11, a first reference point 12, a second reference point 14, and a third reference point 16 are shown as an excerpt of a raster. First reference point 12 has in a first surrounding area 18 a first boundary area 20. Second reference point 14 has in a second surrounding area 22 a second boundary area 24, and third reference point 16 has in a third surrounding area 26 a third boundary area 28. First and second reference points 12, 14 are separated by a distance 30, second and third reference points 14, 16 are separated by a distance 32. The distances are selected (after determination on the basis of printing tests) such that the boundary areas touch at the lines connecting the reference points. In other words the distance between adjacent reference points corresponds to or is essentially, and preferably precisely, equal to the diameter of the boundary area. As a result adjacent surrounding areas overlap to some extent. Additional reference points may be arranged in the direction of the second dimension of printing area 11 such that the boundary areas represent as tight as possible a circular coverage of the printing area. This is the case if a reference point in an adjacent row is the same distance from exactly two adjacent reference points in the row in question.

Figure 2:
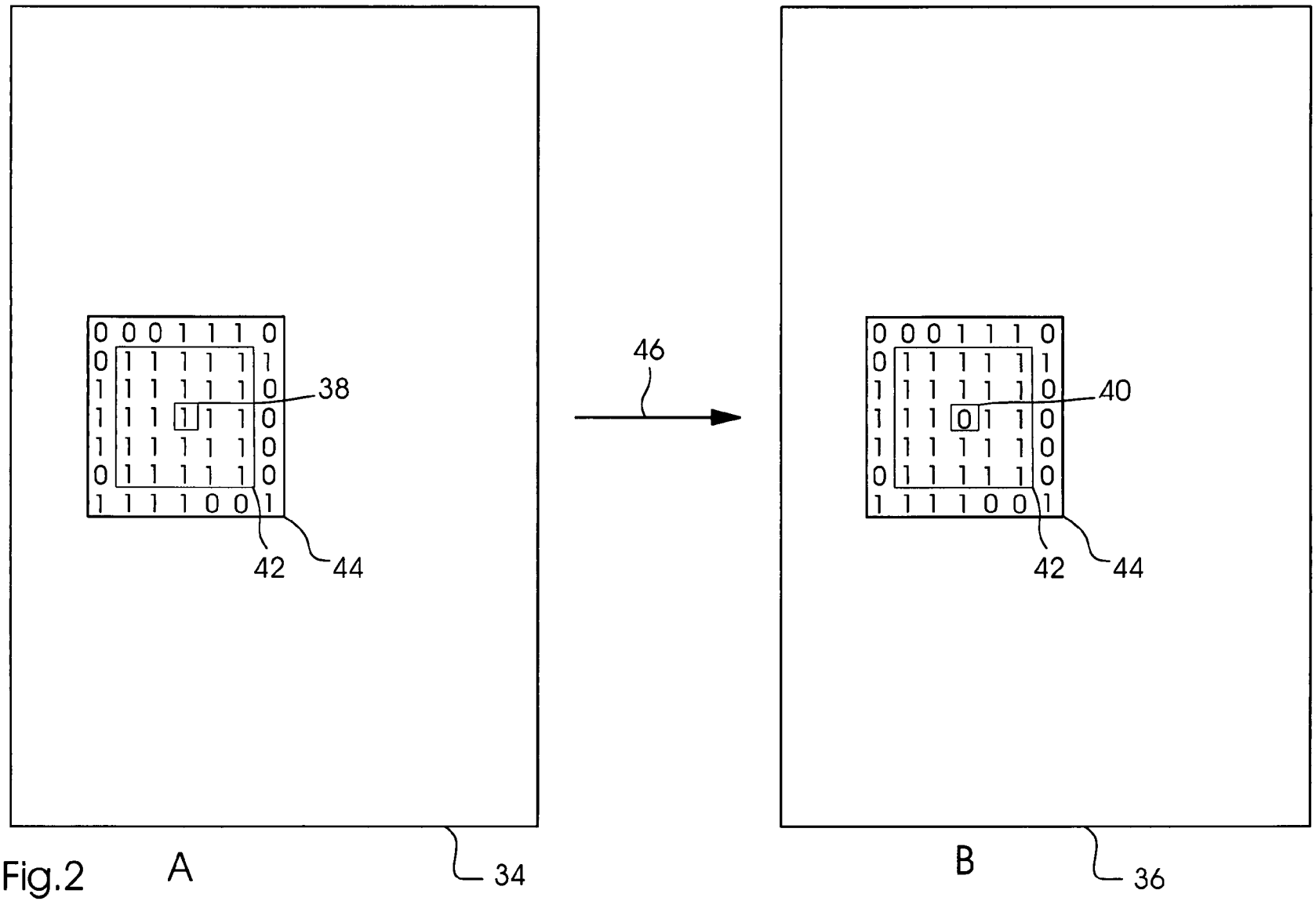
FIG. 2 shows in Sub-figure A an extract of a bit field, in which the image information in the area surrounding a position which corresponds to a reference point is examined and analyzed, and in Sub-figure B an extract of a bit field modified at the position corresponding to a reference point.

FIG. 2 shows in Sub-figure A a bit field in which the image information in an area surrounding a position corresponding to a reference point is examined and analyzed and in its sub-figure B a bit field modified at the position corresponding to a reference point. A surrounding area and a boundary area around a reference point on the printing form (geometric characteristic) correspond to a position in the bit field of the image information and to a first group of bits adjacent to the position and to an adjacent second group of bits surrounding the first group of bits (topological characteristic). If boundary area and surrounding area around a reference point are square, then the groups of bits around a position are also square, as shown in FIG. 2. In order to determine whether or not a supporting point should be set, and if so in order to set a supporting point (i.e., not to undertake imaging at the reference point), before the imaging itself the image information is examined and processed. In the system according to the present invention, this processing takes place in the image processing unit (see also FIG. 6).

Sub-figure A of FIG. 2 shows a bit field 34, in which a first bit group 42 and a second bit group 44 around a position 38 are observed. Position 38 in bit field 34 contains the image information for a specific reference point. In this example the bit at position 38 is set ("1"). Examination of the surrounding area shows that first bit group 42 corresponding to the boundary area contains only set bits ("1"). In addition examination of the surrounding area shows that second bit group 44 corresponding to the surrounding area contains both set ("1 ") and un-set ("0") bits. Set bits in the part of second bit group 44 separate from first bit group 42 are located directly adjacent to first bit group 42. Thus a burn-off area which is larger than the maximum burn-off area not at risk of uncontrolled detachment corresponds to this image information on the printing form in the area surrounding the corresponding reference point.

In consequence, in a modification step 56 the bit at position 38 is changed. Sub-figure B of FIG. 2 shows a modified bit field 36, which may be used for imaging without risk of uncontrolled detachment. After the modification, position 38 is replaced by an un-set bit ("0"). First bit group 42 and second bit group 44 remain unchanged. Thus this modified image information on the printing form corresponds to a surrounding area with a burn-off area, which is detachably stabilized by a supporting point at the reference point, with the result that a controlled complete detachment after the application of energy may be effected in the cleaning step.

Figure 3:
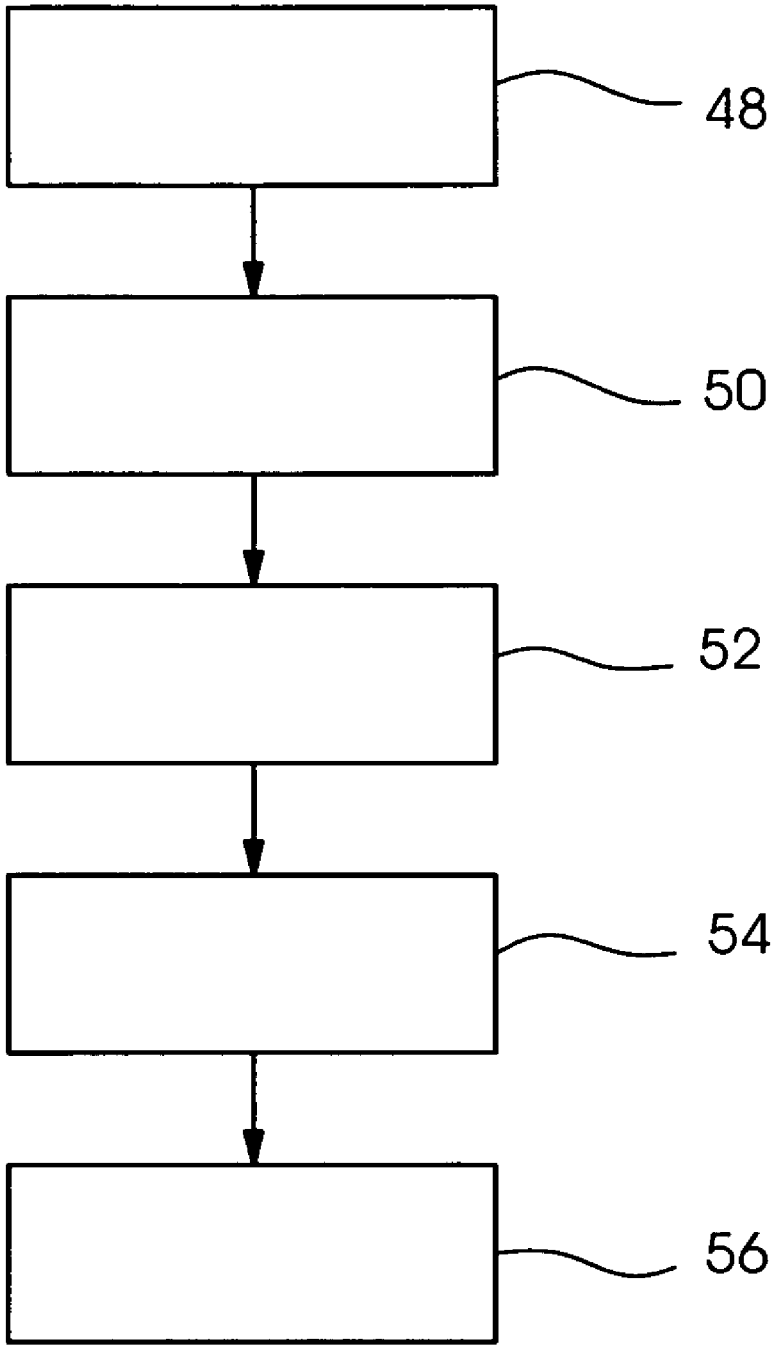
FIG. 3 shows a flow chart over time of one embodiment of the method according to the present invention.

FIG. 3 shows a flow chart over time of one embodiment of the method according to the present invention. In the system for imaging, initially for the method according to the present invention a bit field to be printed is provided (provision step 48). There then follows a surrounding area analysis 50 for one or a plurality of positions in the bit field, corresponding to one or a plurality of reference points on the printing area of the printing form to be imaged. Depending on the result, the bit field is modified at one or a plurality of positions (modification step 52), so that supporting points for the detachable fixing of the burn-off created by non-imaging of image spots on the printing form during imaging with the modified image information may be left in place. On the basis of the modified bit field, imaging 54 of the printing form takes place. In a final cleaning step 56 the burn-off is completely detached. The individual imaging steps may take place under the control of a program in the imaging system.

Figure 4:
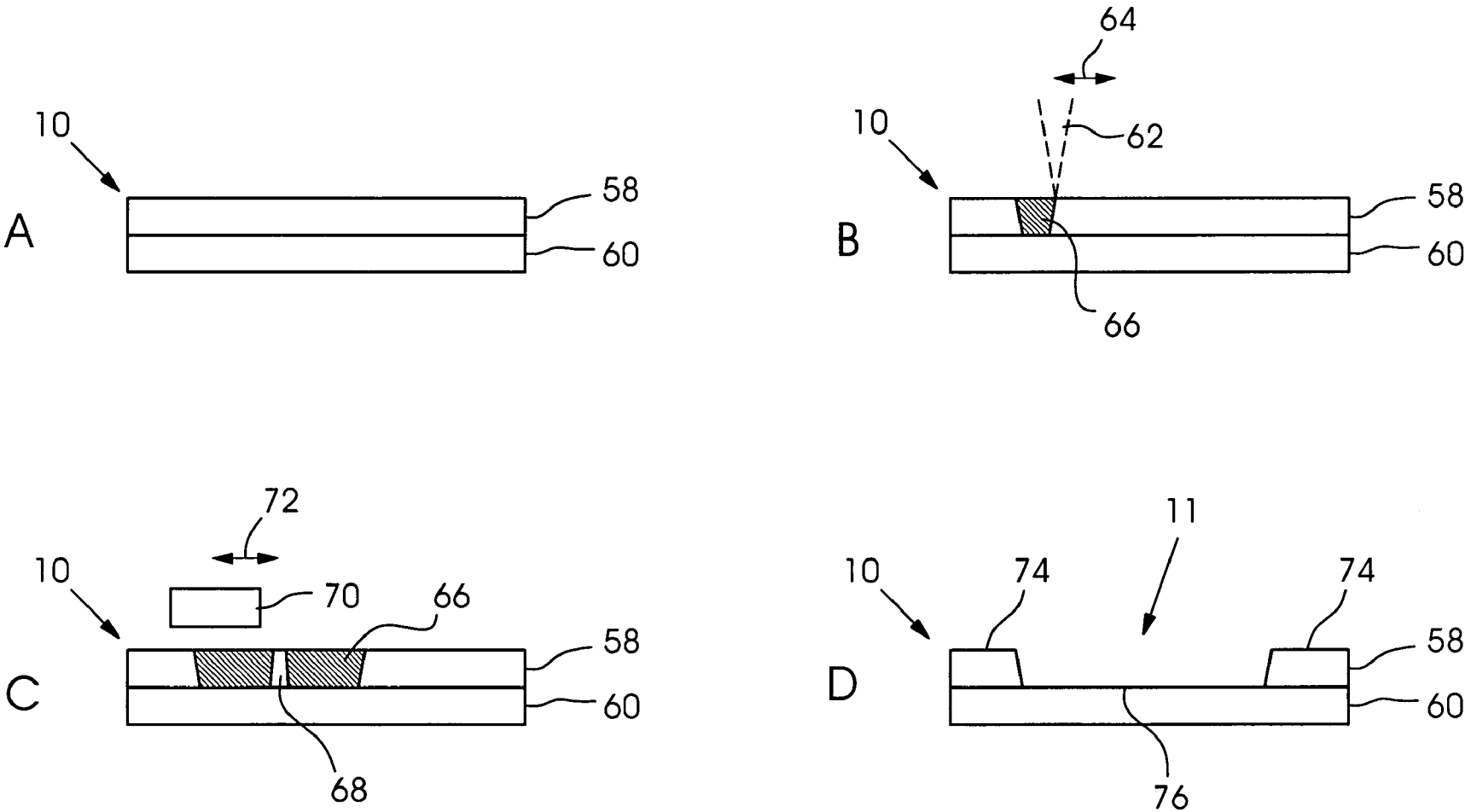
FIG. 4 shows in four sub-figures, A, B, C, and D, a schematic illustration of a printing area of a printing form in various sub-steps of the method according to the present invention.

FIG. 4 is a schematic illustration, in four sub-figures A, B, C, and D, of a printing area of a printing form in various sub-steps of the method according to the present invention. Sub-figure A of FIG. 4 shows a printing form 10 having an upper layer 58, which is lipophobic or ink-repellent, and a layer 60 located below it, which is lipophilic or ink-receptive. Further layers, in particular a carrier layer, may be located under lipophilic layer 60. This printing form is structured in the method according to the present invention into lipophilic and lipophobic sections. In particular, the printing form may be a dry offset printing form, with upper layer 58 including silicone and the layer underneath it including a polymer material, for example polyester, or titanium.

Sub-figure B of FIG. 4 schematically shows how through application or supply of power a change in upper layer 58 may be induced or performed. In this embodiment a light beam 62 is moved in a translation movement 64 over printing form 10. The light energy has the effect that a burn-off area 66 is formed in upper layer 58 of printing form 10.

Sub-figure C of FIG. 4 schematically shows how printing form 10 is subjected to cleaning. Reference may be made first to the situation immediately after the imaging in the method according to the present invention: in upper layer 58, burn-off area 66 has a supporting point 68 in order to detachably fix it. Controlled removal of the burn-off is achieved via a cleaning unit 70 which is passed in a translation movement 72 over printing form 10. The cleaning step may also be assisted by a liquid cleaning agent. In particular the cleaning may be carried out in accordance with a method for cleaning as described in patent EP 0 887 204 A2. The disclosed content of patent EP 0 887 204 A2 is incorporated in this description by reference.

Sub-figure D of FIG. 4, finally, shows the situation after the method for imaging according to the present invention. Printing area 11 of printing form 10 is structured into lipophobic sections 74 and lipophilic sections 76, after the detachable fixing of burn-off area 66 by supporting point 68 has been completely detached in the cleaning step, so that the burn-off may be removed in a controlled manner.

Figure 5:
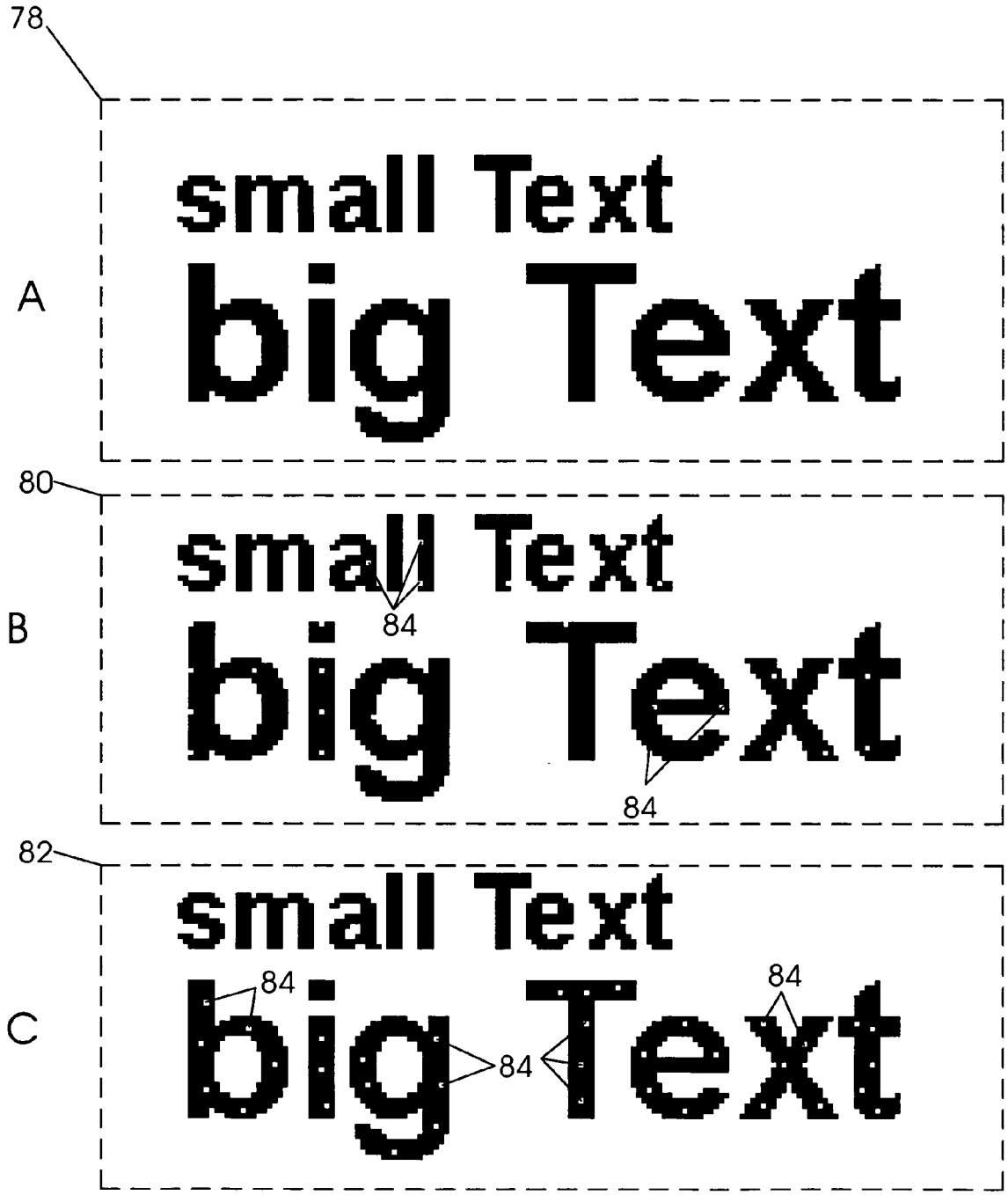
FIG. 5 shows in three sub-figures, A, B, and C, three examples of imaged printing areas: without supporting points, with uniformly distributed supporting points, and with supporting points distributed according to the present invention.

FIG. 5 shows schematically, in three sub-figures A, B, and C, three examples of imaged printing areas: without supporting points, with uniformly distributed supporting points, and with supporting points distributed according to the present invention. Each sub-figure shows as examples two sets of letters: "small text" and "big text." It is clear that the imaged areas in the context of the various imaging subjects may be of any desired form and are not restricted to text characters or textual information. Sub-figure A of FIG. 5 shows a printing area 78 which has been imaged using unmodified image information. In other words, a printing area which has been imaged on the basis of an unchanged bit field.

Sub-figure B of FIG. 5 shows a printing area 80 which has been imaged with uniformly modified image information or on the basis of a uniformly modified bit field. As described in the introductory part of this description, bits may be turned off (changed from the set to the unset state) in accordance with a fixed pattern on a uniform raster so that a regular raster or grid of supporting points is created. In consequence, both "small text" and "big text" contain supporting points 84. In the small areas of "small text" this modification results in a clearly visible change in the presentation. Reference is made in particular to the top left corner of the letter "s," the top right corner of the letter "e," or the left edge of the letter "l." On the other hand, while it is true that in "big text" there are no longer any malformed letters, nevertheless edges are jagged. Reference is made in particular to the left edge of the letter "b" or the upper edge of the capital "T."

Sub-figure C of FIG. 5 shows a printing area 82 which has been imaged using image information modified according to the present invention or on the basis of a bit field modified according to the present invention. If the distribution or the setting of supporting points in the method according to the present invention occurs on the basis of a surrounding area analysis, the bit field is analyzed such that it may be determined whether large cohesive groups of bits occur. If this is the case, a supporting point is created, and the bit at the position in the bit field which corresponds to the reference point is changed from the set to the unset state (see also FIG. 2). In all other cases a supporting point is not created. The effect of this procedure is clearly demonstrated in the results shown in Sub-figure C. In the method according to the present invention for imaging, the printed "small text" is not changed, since the imaged areas are sufficiently small and thus demonstrate an adequate detachable residual adhesion. Within the printed "big text" a supporting point is also not created for the dot of the "i" because this area is also sufficiently small. Supporting points are created in the other characters of this text, but the surrounding area analysis advantageously ensures that these are no longer at the edges.

Figure 6:
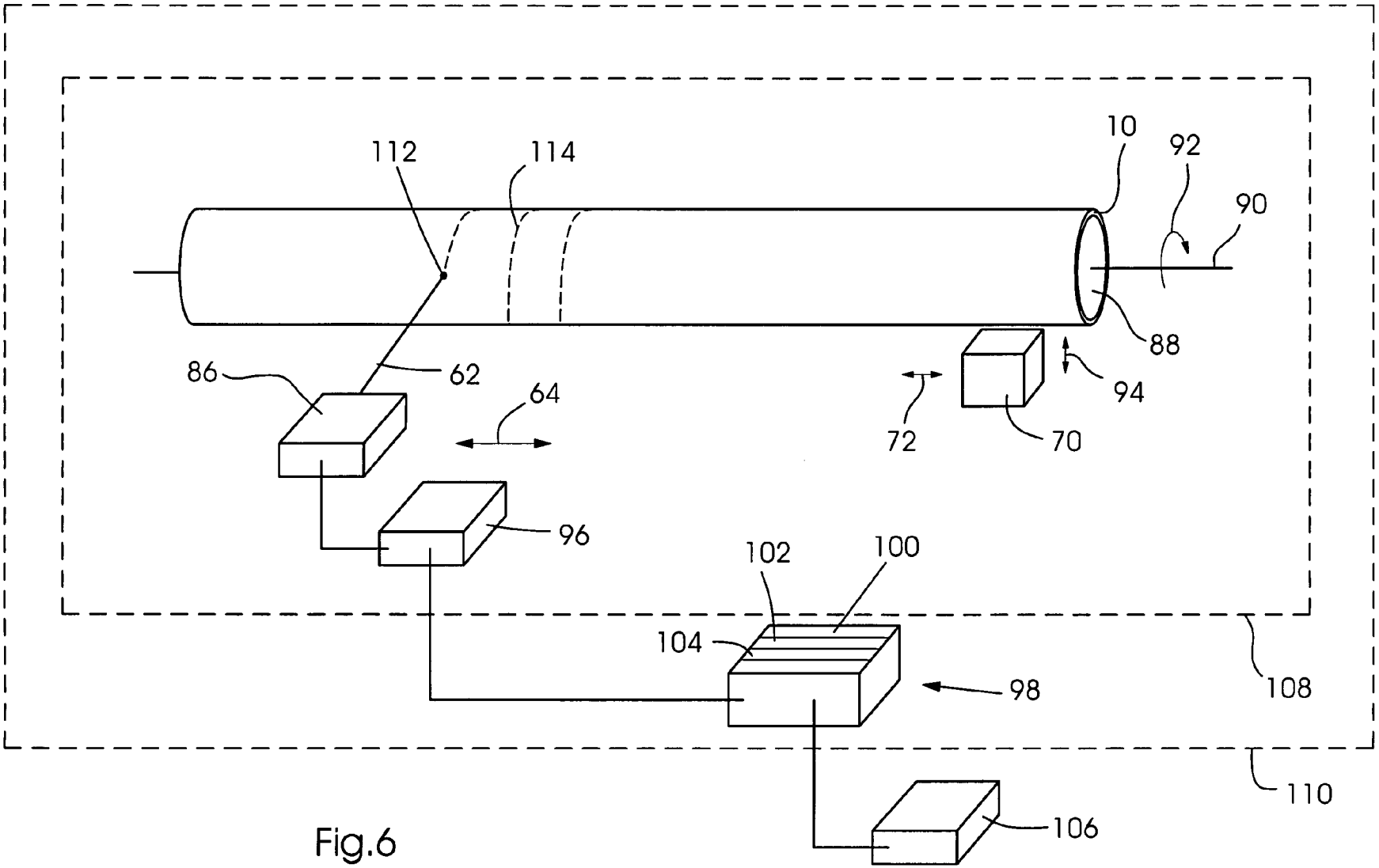
FIG. 6 shows an embodiment of a system for digital imaging of printing forms in the method according to the present invention in the printing unit of a printing press.

FIG. 6 shows an embodiment of a system for digital imaging of printing forms in the method according to the present invention in printing unit 108 of a printing press 100. The system includes an energy source 86 in the form of a laser light source. Here an energy source 86 is shown which emits a beam of light 62, in particular a beam of laser light, preferably near to infra-red. In general, energy sources with a plurality of light beams, which preferably may be activated individually, are also frequently used. A printing form 10 is disposed on a printing form cylinder 88, which is supported such that it is rotatable around cylinder axis 90, as indicated by the arrow of rotational movement 92, in printing unit 108. Light beam 62 impinges on printing form 10 at an image spot 112. Under the joint effect of rotational movement 92 and translation movement 64 of the energy source essentially parallel to cylinder axis 90, image spot 112 of light beam 62 passes over the two-dimensional surface of the printing form along a path 114. The movements are controlled in such a manner that all points of the surface of the printing form in the subsequent printing area are reached by light beam 62 at least once. The system for digital imaging includes a cleaning unit 70 which may be brought into contact with the surface of printing form 10, as indicated by the double arrow of adjustment movement 94. The cleaning unit may be moved essentially parallel to cylinder axis 90. Translation movement 64 and rotational movement 92, operating together, make it possible for all points of the surface of the printing form in the later printing area to be reached at least once by cleaning unit 70, so that after the energy has been supplied the burn-off may be completely removed in the cleaning step of the method according to the present invention. Cleaning unit 70 may also include a suction device to remove burn-off particles.

The system for digital imaging includes a control unit 96, which is linked to energy source 86. Both may be integrated in a compact design. Control unit 96 makes activation of the energy source possible, in accordance with the image information. Signals which represent at least portions of the image information to be imaged are transmitted to control unit 96 from image processing unit 98 linked to it. Those parts of the information to be imaged which belong specifically to the points to be imaged along the path of image spot 112 of light beam 62 over printing form 10 are passed to control unit 96. Image processing unit 98 includes a computing unit 100 in which a program runs to carry out a surrounding area analysis of the image data. Image processing unit 98 includes a raster image processor (RIP) 102 and a data buffer 104 so that modifications to the temporarily stored or buffered image data may be undertaken after processing in raster image processor 102. Image processing unit 98 is connected to a printer pre-stage interface 106, through which image data may reach image processing unit 98.

LIST OF REFERENCE NOTATIONS

10 Printing form
11 Printing area
12 First reference point
14 Second reference point
16 Third reference point
18 First surrounding area
20 First boundary area
22 Second surrounding area
24 Second boundary area
26 Third surrounding area
28 Third boundary area

38 Distance between the first and the second reference points
32 Distance between the second and the third reference points
34 Bit field
36 Modified bit field
38 Bit at position corresponding to a reference point
40 Modified bit at position
42 First bit group in boundary area
44 Second bit group in surrounding area
46 Modification step
48 Provision of a bit field
50 Surrounding area analysis
52 Modification of the bit field
54 Imaging of the printing form
56 Cleaning of the printing form
58 Lipophobic layer
60 Lipophilic layer
62 Light beam
64 Translation movement
66 Burn-off area
68 Supporting point
70 Cleaning unit
72 Translation movement
74 Lipophobic section
76 Lipophilic section
78 Printing area with unmodified image information
80 Printing area with uniformly modified image information
82 Printing area with image information modified according to the present invention
84 Supporting point
86 Energy source
88 Printing form cylinder
98 Cylinder axis
92 Rotational movement
94 Adjustment movement
96 Control unit
98 Image processing unit
100 Computing unit
102 Raster image processor
104 Data buffer
106 Printer pre-stage interface
108 Printing unit
110 Printing press
112 Image spot
114 Path of the image spot

What is claimed is:

1. A method for digital imaging of a printing form through application of energy the method comprising the steps of:

establishing at least one reference point within image data of an image to be imaged onto a printing form and a limit value for a number of image spots within a surrounding area of the at least one reference point;

examining a plurality of image spots in the surrounding area of the at least one reference point in the image data and comparing the number of image spots to be imaged within the surrounding area with the limit value with the image processing unit;

modifying the image data to leave in place the at least one reference point as at least one supporting point if the number of image spots to be imaged in the surrounding area of the at least one reference point exceeds the limit value and a boundary area in the surrounding area around the at least one reference point contains only image spots to be imaged;

applying energy to create bum-off within the image spots around the at least one supporting point in a burn-off area; and detaching burn-off from the burn-off area from the printing form in a cleaning step.

2. The method as recited in claim 1 wherein the number of image spots to be imaged in a surrounding area of a reference point is determined in an analysis of the image data represented in digital form as a bit field.

3. The method as recited in claim 1 further comprising a calibration step prior to the leaving in place step wherein at least one of a geometric shape and extent of the surrounding area, the geometric shape and extent of the boundary area, and the distance from a first reference point to a second reference point of the at least one reference point is determined.

4. The method as recited in claim 1 wherein the at least one reference point includes a plurality of reference points distributed in the image data in a uniform grid over a representation of a printing area of the printing form.

5. The method as recited in claim 1 wherein the distance from a first reference point to a second reference point of the at least one reference point matches an extent of the boundary area.

6. A system for digital imaging of printing forms in a method as recited in claim 1, the system comprising:

an energy source, a cleaning unit, a control unit, and an image processing unit with a computing unit, wherein in the computing unit of the image processing unit a program is executable, the program having at least one executable step determining whether the limit value has been exceeded at a number of positions in a bit field representing the image data in digital form, the positions corresponding to the reference points.

7. The system as recited in claim 6 wherein the image processing unit includes a raster image processor and a data buffer for the image data represented in digital form as a bit field.

8. The system as recited in claim 6 wherein the program has at least one executable step for modifying the bit field in at least one area at the positions at which the limit value is exceeded.

9. A printing unit comprising a system for imaging as recited in claim 6.

10. A printing press comprising a printing unit as recited in claim 9.

* * * * *